US007900740B2

(12) United States Patent
Roley

(10) Patent No.: US 7,900,740 B2
(45) Date of Patent: Mar. 8, 2011

(54) METHOD FOR ADJUSTING A WHEEL AXIS OF ROTATION OF A SCRAPER AND ACTUATION MECHANISM THEREFOR

(75) Inventor: Robert Doyle Roley, Windsor, IL (US)

(73) Assignee: Caterpillar Inc., Peoria, IL (US)

( * ) Notice: Subject to any disclaimer, the term of this patent is extended or adjusted under 35 U.S.C. 154(b) by 22 days.

(21) Appl. No.: 12/290,490

(22) Filed: Oct. 31, 2008

(65) Prior Publication Data

US 2010/0107454 A1 May 6, 2010

(51) Int. Cl.
*B60G 9/02* (2006.01)
*B60G 17/00* (2006.01)
*E02F 3/76* (2006.01)

(52) U.S. Cl. ..... 180/348; 180/376; 180/378; 280/6.15; 280/43.17; 280/43.23; 74/606 R

(58) Field of Classification Search ..... 180/348, 180/374, 376, 378; 280/6.15, 43, 43.17, 280/43.23; 74/606 R
See application file for complete search history.

(56) References Cited

U.S. PATENT DOCUMENTS

| | | | | |
|---|---|---|---|---|
| 2,078,501 | A | 4/1937 | Maloon | |
| 2,283,470 | A | 5/1942 | Sturges | |
| 2,986,402 | A * | 5/1961 | Winton | 280/43.13 |
| 3,063,510 | A | 11/1962 | Hunger et al. | |
| 3,109,506 | A * | 11/1963 | Schroter et al. | 180/8.1 |
| 3,561,538 | A | 2/1971 | Curlett et al. | |
| 3,866,341 | A | 2/1975 | Fabrygel | |
| 4,090,723 | A | 5/1978 | Hart | |
| 5,560,629 | A * | 10/1996 | Allard et al. | 280/414.2 |
| 5,561,924 | A | 10/1996 | Ramey | |
| 5,667,235 | A * | 9/1997 | Pearce et al. | 280/304.1 |
| 5,803,200 | A * | 9/1998 | Brandt | 180/348 |
| 6,041,528 | A | 3/2000 | Broach | |
| 6,092,316 | A | 7/2000 | Brinker | |
| 6,276,077 | B1 | 8/2001 | Kirbie | |
| 6,347,670 | B1 | 2/2002 | Miskin | |
| 7,240,969 | B2 * | 7/2007 | Gu | 301/5.1 |
| 7,284,346 | B2 | 10/2007 | Miskin | |
| 7,398,843 | B2 * | 7/2008 | Buehler et al. | 180/8.1 |
| 2002/0089107 | A1 * | 7/2002 | Koh | 267/218 |
| 2004/0004333 | A1 * | 1/2004 | Riermann | 280/43.17 |

OTHER PUBLICATIONS

Caterpillar U.S. Appl. No. 11/897,041, filed Aug. 29, 2007.

* cited by examiner

*Primary Examiner* — Paul N. Dickson
*Assistant Examiner* — George D. Spisich
(74) *Attorney, Agent, or Firm* — Leydig, Voit & Mayer

(57) ABSTRACT

A machine includes an axle assembly coupled with a frame and defining a central axis. The axle assembly includes a wheel axle disposed within a spindle housing, and a rotary actuator configured to rotate the wheel axle about the central axis by rotating the spindle housing. According to one embodiment, for example, the rotary actuator may be configured to adjust a wheel axis of rotation relative to the frame of a machine, such as a scraper, by rotating the spindle housing.

16 Claims, 5 Drawing Sheets

METHOD FOR ADJUSTING A WHEEL AXIS OF ROTATION OF A SCRAPER AND ACTUATION MECHANISM THEREFOR

TECHNICAL FIELD

The present disclosure relates generally to a method and actuation mechanism for raising and lowering a machine frame, and more particularly to a method and actuation mechanism for adjusting a wheel axis of rotation relative to the frame.

BACKGROUND

Earthmoving equipment is used to perform a variety of operations, including loading, or capturing, material, such as soil, at one location and dumping, or depositing, the material at another location. For example, such material movement may be employed to adjust elevations at a project site. Scrapers, which typically provide quick load, dump, and maneuver time, may be used to perform such operations, and generally include a machine having a bowl within which the material may be captured, and a cutting edge located adjacent a cut opening of the bowl. Although various scraper configurations are available, scrapers are often pulled by a tractor, such as a wheeled or track type tractor. In addition, scrapers may provide their own traction via a separate engine that applies rim pull, or power, to the wheels of the scraper. In either arrangement, scrapers may also be pushed or pulled by a separate machine, or tractor, to provide additional power for scraper operations.

During a typical operation, or duty cycle, the scraper may be pulled forward, at a material capturing location, while the cutting edge of the bowl is pivoted downward to cut through the material. The cutting edge, oriented perpendicular to the direction of travel, may also serve to guide the material into the bowl. When the bowl is loaded to some desired capacity, the cutting edge of the bowl may be pivoted upward so that the cutting edge is out of contact with the material, and the machine may be transported to a location where the soil is to be deposited. After the material is deposited, often with the assistance of an ejector mechanism, the scraper may be returned to the material capturing location, and the duty cycle may be repeated.

Often, there is a desire to provide a level cut with the cutting edge of the scraper. However, if the bowl of the scraper is loaded unevenly, a side of the bowl may be weighted more heavily, which may result in an uneven cut. Operating across a path having various topographical changes may cause the left or right set of wheels to operate at an elevated level relative to the other set of wheels, which may also result in an uneven cut. To improve cutting in these situations, the cutting edge may be adjusted toward a parallel position relative to the material. According to one example, as shown in U.S. Pat. No. 5,561,924, one of the wheel hubs, supporting left and right wheels on eccentric spindles, may be rotated slightly to tilt the bowl of the scraper and, thus, cutting edge, to reorient the cutting edge relative to the ground. Specifically, a linear actuator, actuated by a motor, is used to independently adjust a rotation of the wheel hubs, through a horizontal displacement, to tilt the bowl and, thus, cutting edge relative to the ground. Although this arrangement may provide more even cutting, it should be appreciated that there is also a continuing need to improve efficiency of scraper operations by reducing the energy required to fill the bowl to its desired capacity.

The present disclosure is directed to one or more of the problems set forth above.

SUMMARY OF THE DISCLOSURE

In one aspect, a machine includes an axle assembly coupled with a frame and defining a central axis. The axle assembly includes a wheel axle disposed within a spindle housing, and a rotary actuator configured to rotate the wheel axle about the central axis by rotating the spindle housing.

In another aspect, a machine includes a frame and an axle assembly coupled with the frame. The axle assembly includes a central axle having a central axle gear at an end thereof. A first wheel axle is disposed within a first spindle housing and includes a first wheel axle gear rotatably coupled with the central axle gear. An actuator is configured to rotate the first wheel axle about the central axle by rotating the first spindle housing.

In yet another aspect, a scraper includes a scraper bowl supported on a frame and having a scraper blade disposed at a front portion thereof. An axle assembly, including a central axle, is coupled with the frame and disposed at a rear portion of the scraper bowl. A first wheel axle is rotatably coupled with a first end of the central axle and disposed within a first spindle housing. A second wheel axle is rotatably coupled with a second end of the central axle and disposed within a second spindle housing. A rotary actuator is configured to rotate the first wheel axle and the second wheel axle about the central axle by rotating the first spindle housing and the second spindle housing.

DETAILED DESCRIPTION

Figure 1:
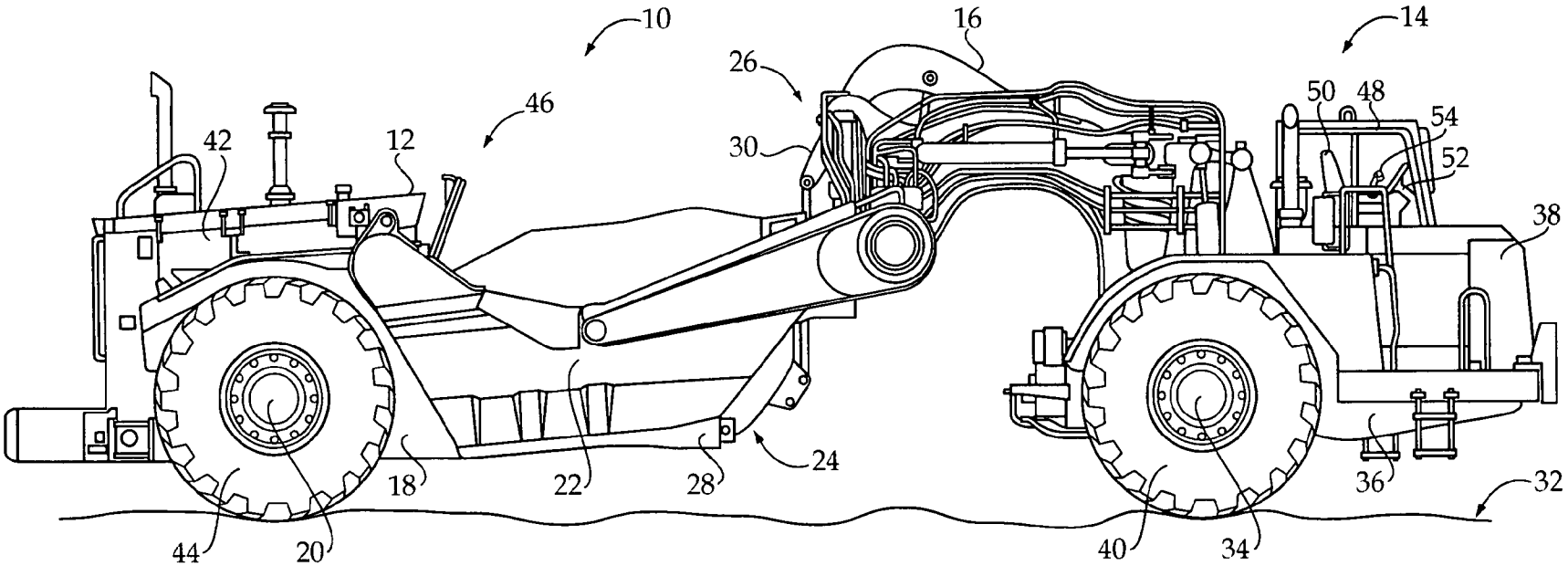
FIG. 1 is a side diagrammatic view of a machine, according to the present disclosure.

An exemplary embodiment of a machine 10 is shown generally in FIG. 1. The machine 10, as shown, includes a scraper 12 attached to a tractor 14 through an articulated hitch 16. Although the tractor 14 is depicted as a wheeled tractor, it should be appreciated that scraper 12 may be attached and, thus, pulled or towed by any machine or vehicle, including wheeled or track type tractors. The scraper 12, which may generally include a frame 18 having an axle assembly 20 about which a scraper bowl 22 may pivot, may also be operated in a variety of configurations, including, for example, a push-pull configuration, as is well known in the art.

Scraper bowl 22 may define a cut opening 24, at a front portion 26 of the scraper bowl 22, with a cutting edge, such as a scraper blade 28, positioned adjacent the cut opening 24. During an exemplary operation, the scraper bowl 22 may be pivoted downward about the axle assembly 20, such as by using one or more scraper bowl actuators or cylinders 30, to engage the scraper blade 28 with material 32, such as, for example, soil. Such material 32 may be collected within the scraper bowl 22 as the tractor 14 and scraper 12 are maneuvered over the material 32. Although a simplified embodiment is described, it should be appreciated that scraper 12 may include additional components or features, such as, for example, an auger attachment, elevator mechanism, or ejector.

The tractor 14 may provide the sole means for propulsion and, in such arrangements, the tractor 14 and scraper 12 may include a single drive axle, such as, for example, a drive axle of a front axle assembly 34. The front axle assembly 34 may be coupled with a frame 36, or front frame, of the tractor 14, which may support a front engine compartment 38. An engine, such as an internal combustion engine, or other power source may be housed within the front engine compartment 38 and may provide power to front wheels 40 of the front axle assembly 34. According to some embodiments, the scraper 12 may also include propulsion means, such as an internal combustion engine or other power source disposed within a rear engine compartment 42, for driving rear wheels 44 of axle assembly 20, also referenced herein as a rear axle assembly. The rear axle assembly 20, disposed at a rear portion 46 of the scraper bowl 22, may thus, according to such tandem powered arrangements, provide its own power, or traction.

An operator control station 48 may be supported on the front frame 36, and may include known devices, such as, for example, a seat assembly 50 and a steering device 52 that facilitate operator control of the tractor 14 and/or scraper 12. The operator control station 48 may include various other devices, including, but not limited to, one or more machine operation controllers 54. For example, one or more machine operation controllers 54 may be provided for selecting or controlling an engine speed of an internal combustion engine provided within either or both of engine compartments 38 and 42. Further, one or more machine operation controllers 54 may be provided for controlling operation of the scraper 12, such as by controlling movement of the scraper bowl actuators or cylinders 30. Additional controls and devices, as should be appreciated, may also be provided within the operator control station 48 for controlling various operational aspects of the tractor 14 and/or scraper 12. Such control, as referenced herein, may include either of mechanical or electronic control means, or a combination thereof.

Figure 2:
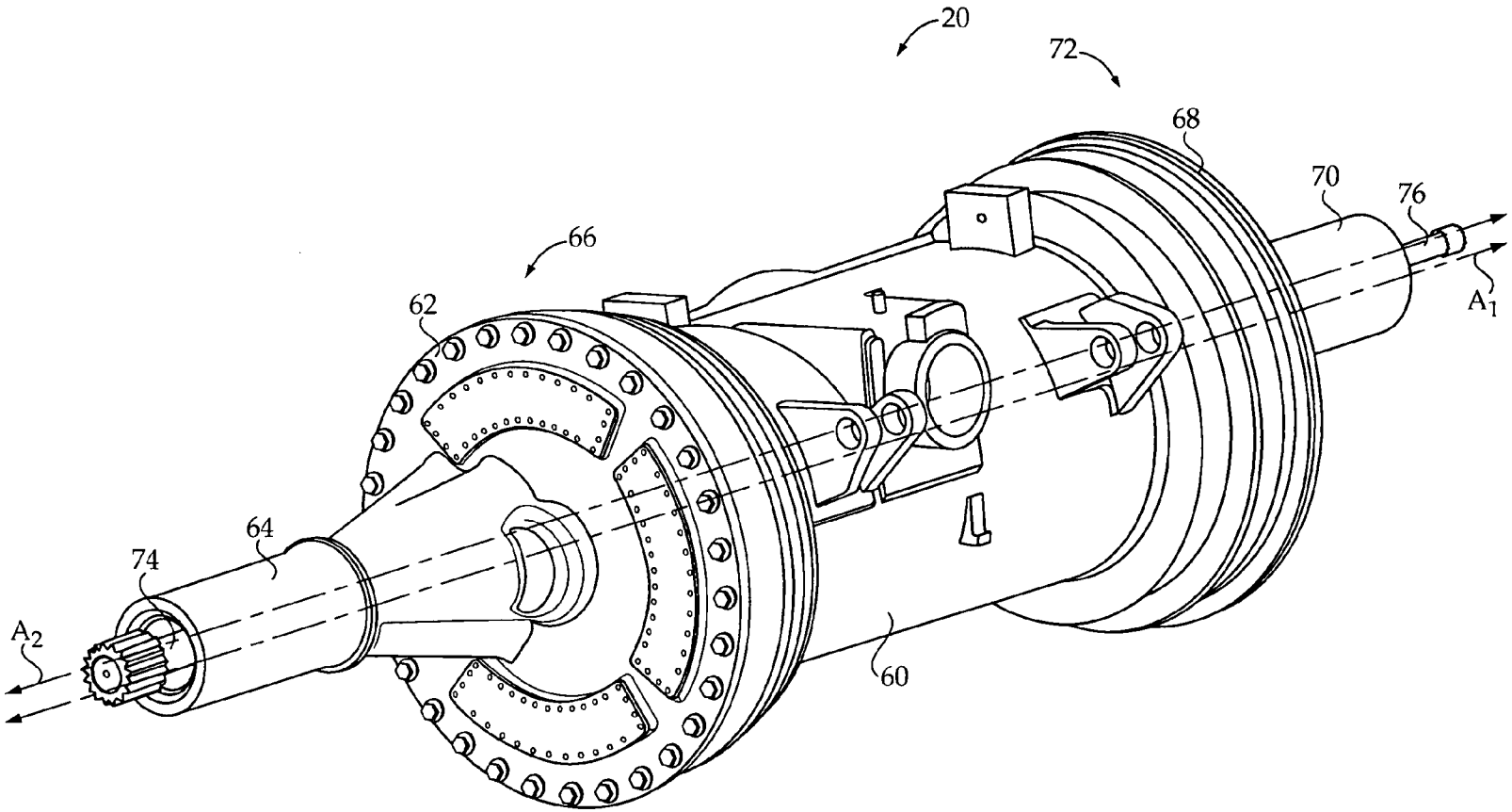
FIG. 2 is a perspective view of an axle assembly of the machine of FIG. 1.

Turning now to FIG. 2, portions of the axle assembly 20, or rear axle assembly, of the scraper 12 are shown. The rear axle assembly 20 may be attached to the frame 18 of the scraper 12 using any known attachment means, and may support wheels, such as the rear wheels 44 shown in FIG. 1. The rear axle assembly 20, according to one embodiment, may generally include a central housing 60 that may be oriented along a first, or central, axis $A_1$ and may include the attachment means (e.g., fasteners) to frame 18, referenced above. A first spindle housing 62, including a first offset channel 64, may be attached to the central housing 60 at a first end 66 of the central housing 60. Similarly, a second spindle housing 68, having a second offset channel 70, may be attached at a second end 72 of the central housing 60. First and second offset channels 64 and 70, defining a wheel axis of rotation, or offset axis, $A_2$, according to the exemplary embodiment, may be radially spaced from the central axis $A_1$.

Figure 3:
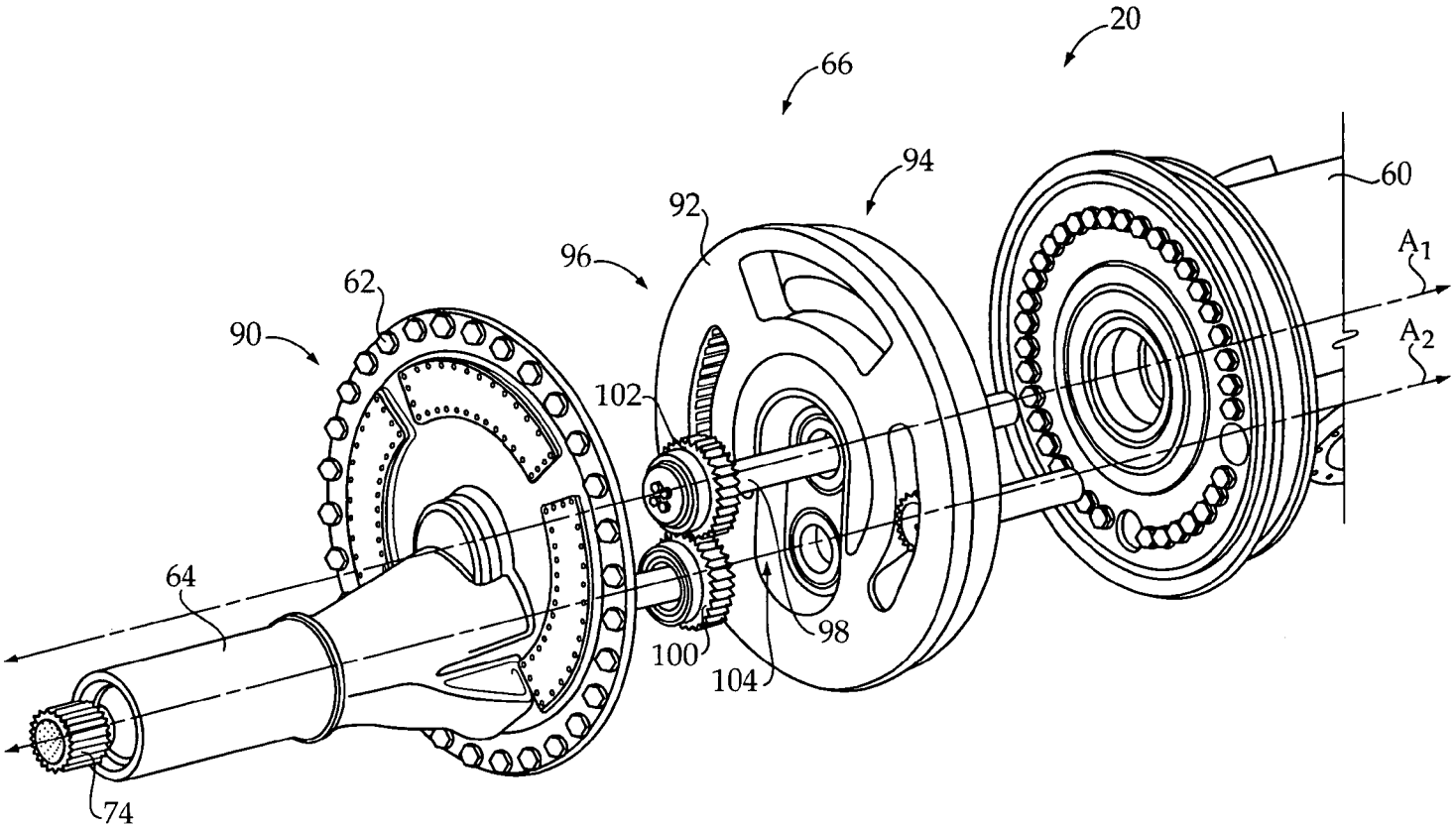
FIG. 3 is a partially exploded perspective view of a portion of the axle assembly of FIG. 2.

A first wheel axle 74 and a second wheel axle 76, which may each be powered by an internal combustion engine, or other power source, of rear engine compartment 42, may, in turn, be configured to drive wheels, such as wheels 44 of FIG. 1. Specifically, as shown, the first wheel axle 74 may be disposed within the first offset channel 64, while the second wheel axle 76 may be disposed within the second offset channel 70. According to one embodiment, the set of wheel axles 74 and 76 may be configured to drive wheels 44 (FIG. 1), which may each include a pair of wheels, through a final drive assembly, or final drive planetary gear set, as is known in the art. As such, the wheels, such as wheels 44 of FIG. 1, may be rotatably mounted on the first and second spindle housings 62 and 68 or, more specifically, first and second offset channels 64 and 70. It should be appreciated, however, that, according to some embodiments, wheels 44 may not be directly driven by an engine, or other power source, of scraper 12 and, therefore, some of the drive components described herein may be eliminated Since the second end 72 of central housing 60, including second spindle housing 68, may represent a mirror image of the corresponding components described with respect to the first end 66, only the first end 66 will be described in greater detail. Specifically, as shown in FIG. 3, the first spindle housing 62, at a first end 90 thereof, may be connected to the central housing 60 through a repositioning disk 92. More specifically, a first side 94 of the repositioning disk 92 may be rotatably received within the central housing 60, such as by using known wheel or roller bearings, while a second side 96 of the repositioning disk 92 may be fixedly attached, such as through a bolted connection, to the first spindle housing 62. A central axle 98, which may be disposed within the central housing 60 and oriented along the central axis $A_1$, may be configured to drivingly engage the first wheel axle 74. According to one embodiment, for example, a wheel axle gear 100 of the first wheel axle 74 and a central axle gear 102 of the central axle 98 may be rotatably coupled, or in mesh, and may be disposed within an opening 104 of the repositioning disk 92.

Figure 4:
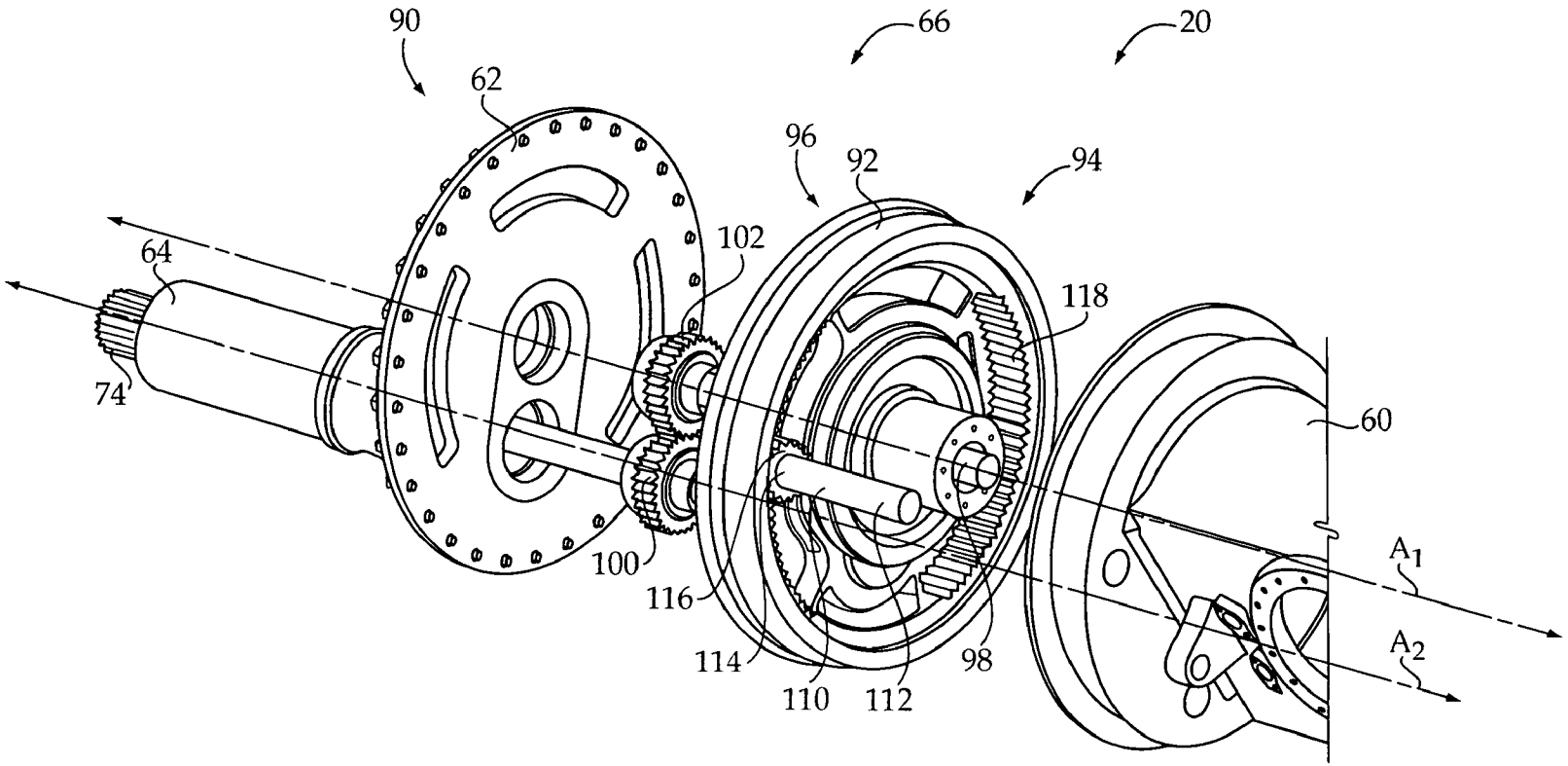
FIG. 4 is an alternative perspective view, shown partially exploded, of the axle assembly of FIG. 2.

Turning now to FIG. 4, a repositioning drive shaft, such as a first repositioning drive shaft, shown generally at 110, may include a first driven end 112 and a second driving end 114. The second driving end 114 may include a repositioning drive gear 116, which may be rotatably coupled, or in mesh, with an internal gear surface 118 of the repositioning disk 92. It should be appreciated that the repositioning disk 92, having a fixed position relative to the first spindle housing 62, may be integral with the first spindle housing 62. As a result, the internal gear surface 118 may be provided on a surface, such as an internal surface, of the first spindle housing 62. The internal gear surface 118 may be continuous about the internal surface of the repositioning disk 92 or may be discontinuous, as shown. According to one embodiment, it may be preferable to provide sufficient gear surface 118 to allow rotation of the repositioning disk 92 and, thus, first spindle housing 62, through at least 170 degrees. Further, it may be desirable to rotate both the first spindle housing 62 and the second spindle housing 68 through at least about 180 degrees.

Figure 5:
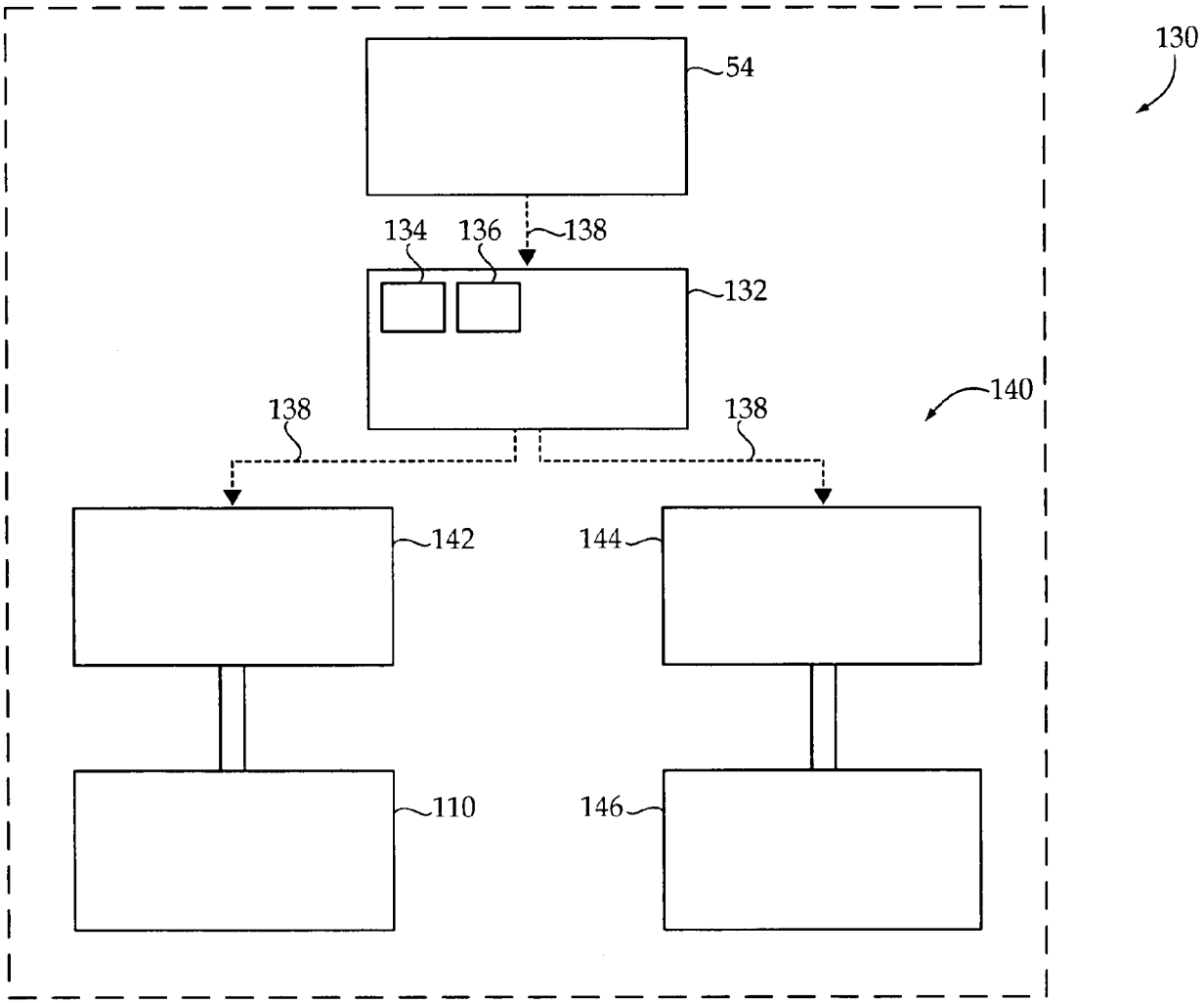
FIG. 5 is a simplified block diagram of a control system for use with the machine of FIG. 1.

An exemplary control system for controlling the scraper 12, and other components, of machine 10 and/or tractor 14 is shown generally at 130 in FIG. 5. Specifically, the control system 130 may be an electronic control system including one or more electronic controllers, such as electronic controller 132, for controlling one or more of the various components or systems of the scraper 12 and/or tractor 14. The electronic controller 132 may be of standard design and may include a processor 134, such as, for example, a central processing unit, a memory 136, and an input/output circuit that facilitates communication internal and external to the electronic controller 132. The processor 134 may control operation of the electronic controller 134 by executing operating instructions, such as, for example, computer readable program code stored in memory 136, wherein operations may be initiated internally or externally to the electronic controller 132. A control scheme may be utilized that monitors outputs of systems or devices, such as, for example, sensors, actuators, or control units, via the input/output circuit to control inputs to various other systems or devices.

The memory 136 may comprise temporary storage areas, such as, for example, cache, virtual memory, or random access memory, or permanent storage areas, such as, for example, read-only memory, removable drives, network/internet storage, hard drives, flash memory, memory sticks, or any other known volatile or non-volatile data storage devices. Such devices may be located internally or externally to the electronic controller 132. One skilled in the art will appreciate that any computer based system or device utilizing similar components for controlling the machine systems or components described herein, is suitable for use with the present disclosure.

The electronic controller 132, and additional electronic controllers of the control system 130, may communicate via one or more wired and/or wireless communications lines 138, or other similar input/output circuits. Further, the electronic controller 132 may communicate with one or more sensors, or other devices, associated with the specific machine system(s) controlled by the electronic controller 132. For example, and referring generally to FIGS. 1-5, electronic controller 132 may be configured to identify a desired position, such as a desired vertical position, of the rear portion 46 of the scraper bowl 22, based on the position of one of the machine operation controllers 54, and, in response, adjust the wheel axis of rotation $A_2$ relative to the central axis $A_1$ using an actuator 140.

The actuator 140, also referred to herein as a rotary actuator, may include a first electronically controlled rotation mechanism 142 and a second electronically controlled rotation mechanism 144. The first and second electronically controlled rotation mechanisms 142 and 144, which may, for example, include electric or hydraulic motors, may be configured to rotate the first repositioning drive shaft 110 and a second repositioning drive shaft 146, respectively. The second repositioning drive shaft 146, as should be appreciated, may operate in a manner similar to that of first repositioning drive shaft 110 and, therefore, will not be separately described. Specifically, for example, the first electronically controlled rotation mechanism 142 may be configured to rotate the first driven end 112 of the repositioning drive shaft 110. As a result of the rotation, the repositioning drive gear 116 of the repositioning drive shaft 110 may drivingly engage the internal gear surface 118 and, thus, rotate the repositioning disk 92 and first spindle housing 62 relative to the central housing 60. Further, such rotation may cause the first wheel axle 74, disposed within the first offset channel 64 of first spindle housing 62, to rotate about the central axis $A_1$ or, according to the exemplary embodiment, central axle 98.

Accordingly, the electronic controller 132 may adjust, or rotate, the wheel axis of rotation $A_2$, defined by offset channels 64 and 70, relative to the central axis $A_1$, through a continuous range of orientations, as provided by the internal gear surface 118. Further, an alignment feature may be provided to maintain the pair of wheel axles 74 and 76 along the offset axis $A_2$ during rotation. For example, the electronic controller 132, in response to actuation of a machine operation controller 54, may be configured to simultaneously transmit a first actuation signal to the first electronically controlled rotation mechanism 142 and a second actuation signal to the second electronically controlled rotation mechanism 144 to rotate first and second wheel axles 74 and 76 to similar orientations relative to the central axis $A_1$. Such adjustment means may allow a greater vertical displacement of the wheel axis of rotation $A_2$, as defined by first and second wheels axles 74 and 76, relative to the central axis $A_1$ than horizontal displacement.

It should be appreciated that the axle assembly 20 and control system 130, as described herein, may provide a means for adjusting a vertical position of the frame 18, which supports the rear portion 46 of scraper bowl 22. Such adjustments may be made electronically and, further, may be made in response to a position of the front portion 26 of the scraper bowl 22 and/or a weight of material 32 within the scraper bowl 22. For example, it may be desirable to lower the rear portion 46 of the scraper bowl 22, by adjusting the wheel axis of rotation $A_2$, when the front portion 26 and, thus, cutting edge 28 of the scraper bowl 22 has been lowered and at least some material 32 has been collected within the scraper bowl 22. Once the scraper bowl 22 has reached a desired capacity, and the collected material 32 is being deposited at a desired location, the wheel axis of rotation $A_2$ may be raised, or returned to a neutral position, using the adjustment means described herein. Additional adjustments, as should be appreciated, may be made, as desired, throughout operation of the scraper 12.

INDUSTRIAL APPLICABILITY

The present disclosure finds potential application in any machine, such as a tractor scraper or a towed scraper, which utilizes a bowl, such as a scraper bowl. Further, the disclosure may be specifically applicable to scrapers having a cutting edge of the scraper bowl that may be lowered by pivoting the cutting edge about an axle assembly. Yet further, the present disclosure may be applicable to scrapers requiring improved efficiency, including reduced energy consumption, during operations. Such machines may include, but are not limited to, single engine scrapers, tandem powered scrapers, scrapers operating in a push-pull configuration, and other machines known in the art that utilize a bowl for collecting material.

Referring generally to FIGS. 1-5, a machine 10, such as a scraper 12, may be pulled by a tractor 14 and may generally include a frame 18 and a rear axle assembly 20, about which a scraper bowl 22 may pivot. The scraper bowl 22 may define a cut opening 24, at a front portion 26 of the scraper bowl 22, with a cutting edge, such as a scraper blade 28, positioned adjacent the cut opening 24. During an exemplary operation, the scraper bowl 22 may be pivoted downward about the rear axle assembly 20, such as by using one or more scraper bowl actuators or cylinders 30, to engage the scraper blade 28 with material 32, such as, for example, soil. Such material 32 may be collected within the scraper bowl 22 as the tractor 14 and scraper 12 are maneuvered over the material 32. It should be appreciated that, as the machine 10 is moved over the material 32 and the scraper blade 28 of the scraper bowl 22 is engaged with the material 32, the scraper bowl 22 will become partially filled with material 32. The weight of the material 32, which may be positioned toward the front portion 26 of the angled scraper bowl 22, may cause an increase in the amount of power and, thus, energy required to maneuver the tractor 14 and scraper 12 over the material 32.

Utilizing the axle assembly 20 and method, as may be implemented by control system 130, described herein, may reduce energy consumption when machine 10 is at least partially loaded, as described above. Specifically, for example, when a partially loaded state of the scraper bowl 22 is detected, an operator may actuate a machine operation controller 54 to effectively lower a rear portion 46 of the scraper bowl 22 and, thus, reduce an angle of the scraper bowl 22 relative to the ground. Such adjustment, as should be appreciated, may reduce the energy, or power, required to maneuver the partially loaded and, thus, weighted scraper bowl 22 over the material 32. Additional benefits, including improvements to unloading material 32 from scraper bowl 22 by adjusting the wheel axis of rotation $A_2$, may also be recognized.

It should be appreciated that the rotary actuator 140, as described herein, may include any actuator causing movement by rotating or turning on an axis. As such, the rotary actuator 140 described herein does not include a linear actuator for causing rotation, such as rotation of first spindle housing 62 relative to central housing 60. Specifically, as explained above, rotary actuator 140 includes, for example, first repositioning drive shaft 110 that, when rotated, engages repositioning drive gear 116 with internal gear surface 118 to rotate first spindle housing 62. Rotating first spindle housing 62, as should be appreciated, causes rotation of first wheel axle 74 about central axle 98. Rotating both first wheel axle 74 and second wheel axle 76, as described herein, effectively adjusts wheel axis of rotation $A_2$ relative to the frame 18, thus raising or lowering the rear portion 46 of the scraper bowl 22 relative to the ground. Further, such rotation may be effected while power is transmitted through the central axle 98 to first and second wheel axles 74 and 76.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A machine, comprising:

a frame; and an axle assembly coupled with the frame and including a spindle housing defining a central axis, the axle assembly including a wheel axle disposed within the spindle housing, and a rotary actuator configured to rotate the wheel axle about the central axis by rotating the spindle housing, wherein the rotary actuator rotates on an axis to rotate the spindle housing.

2. The machine of claim 1, wherein the wheel axle is disposed within an offset channel of the spindle housing, the offset channel being radially spaced from the central axis.

3. The machine of claim 2, wherein the axle assembly further includes a central axle oriented along the central axis and disposed within a central housing, the central axle having a central axle gear rotatably coupled with a wheel axle gear of the wheel axle.

4. The machine of claim 3, further including a repositioning disk having a first side rotatably received within the central housing and a second side fixedly attached to the spindle housing, wherein the central axle gear and the wheel axle gear are disposed within an opening of the repositioning disk.

5. The machine of claim 4, wherein the rotary actuator includes a repositioning drive shaft having a repositioning drive gear rotatably coupled with an internal gear surface of the repositioning disk.

6. A machine, comprising:

a frame;

an axle assembly coupled with the frame and including a spindle housing defining a central axis, the axle assembly including a wheel axle disposed within the spindle housing, and a rotary actuator configured to rotate the wheel axle about the central axis by rotating the spindle housing;

wherein the wheel axle is disposed within an offset channel of the spindle housing, the offset channel being radially spaced from the central axis; and wherein the rotary actuator includes a repositioning drive shaft having a repositioning drive gear rotatably coupled with an internal gear surface of the spindle housing.

7. The machine of claim 6, further including an electronically controlled rotation mechanism configured to rotate the repositioning drive shaft.

8. The machine of claim 6, wherein the repositioning drive shaft is configured to rotate the spindle housing through at least 170 degrees.

9. A machine, comprising:

a frame; and an axle assembly coupled with the frame and including a central axle having a central axle gear at an end thereof, a first wheel axle disposed within a first spindle housing and having a first wheel axle gear rotatably coupled with the central axle gear, and an actuator configured to rotate the first wheel axle about the central axle by rotating the first spindle housing.

10. The machine of claim 9, wherein the central axle is disposed within a central housing having first and second ends and oriented along a central axis.

11. The machine of claim 10, wherein the first wheel axle is disposed within a first offset channel of the first spindle housing, the first spindle housing being rotatably coupled with the first end of the central housing.

12. The machine of claim 11, wherein the axle assembly further includes a second wheel axle disposed within a second offset channel of a second spindle housing, the second spindle housing being rotatably coupled with the second end of the central housing, and the second wheel axle being rotatably coupled with the central axle.

13. The machine of claim 12, wherein the actuator includes a rotary actuator configured to rotate the first spindle housing and the second spindle housing relative to the central housing.

14. The machine of claim 13, wherein the rotary actuator includes a first repositioning drive shaft rotatably coupled with the first spindle housing, and a second repositioning drive shaft rotatably coupled with the second spindle housing.

15. The machine of claim 14, further including an electronically controlled rotation mechanism configured to rotate the first repositioning drive shaft and the second repositioning drive shaft.

16. The machine of claim 15, wherein the electronically controlled rotation mechanism is further configured to rotate the first spindle housing and the second spindle housing through at least 170 degrees.

* * * * *